United States Patent [19]

Crispin et al.

[11] Patent Number: 4,911,107

[45] Date of Patent: Mar. 27, 1990

[54] STANDBY COOLING SYSTEM FOR A FLUIDIZED BED BOILER

[75] Inventors: Larry G. Crispin, Akron; Paul S. Weitzel, Canal Fulton, both of Ohio

[73] Assignee: The Babcock & Wilcox Company, New Orleans, La.

[21] Appl. No.: 363,753

[22] Filed: Jun. 9, 1989

[51] Int. Cl.[4] ..... F22B 33/00

[52] U.S. Cl. ..... 122/1 R; 122/4 D; 122/507

[58] Field of Search ..... 60/39.48, 39.12, 663; 122/1 R, 4 D, 451.1, 504, 507

[56] References Cited

U.S. PATENT DOCUMENTS 4,493,186 1/1985 Emsperger et al. ..... 60/663
4,495,899 1/1985 Carberry ..... 122/1 R
4,800,846 1/1989 Idei et al. ..... 122/4 D
4,845,942 7/1989 Schemenau et al. ..... 122/4 D

*Primary Examiner*—Henry C. Yuen
*Attorney, Agent, or Firm*—Robert J. Edwards

[57] ABSTRACT

A system for protecting components including the heat exchangers of a fluidized bed boiler against thermal mismatch. The system includes an injection tank containing an emergency supply of heated and pressurized feedwater. A heater is associated with the injection tank to maintain the temperature of the feedwater in the tank at or about the same temperature as that of the feedwater in the heat exchangers. A pressurized gas is supplied to the injection tank to cause feedwater to flow from the injection tank to the heat exchangers during thermal mismatch.

14 Claims, 1 Drawing Sheet

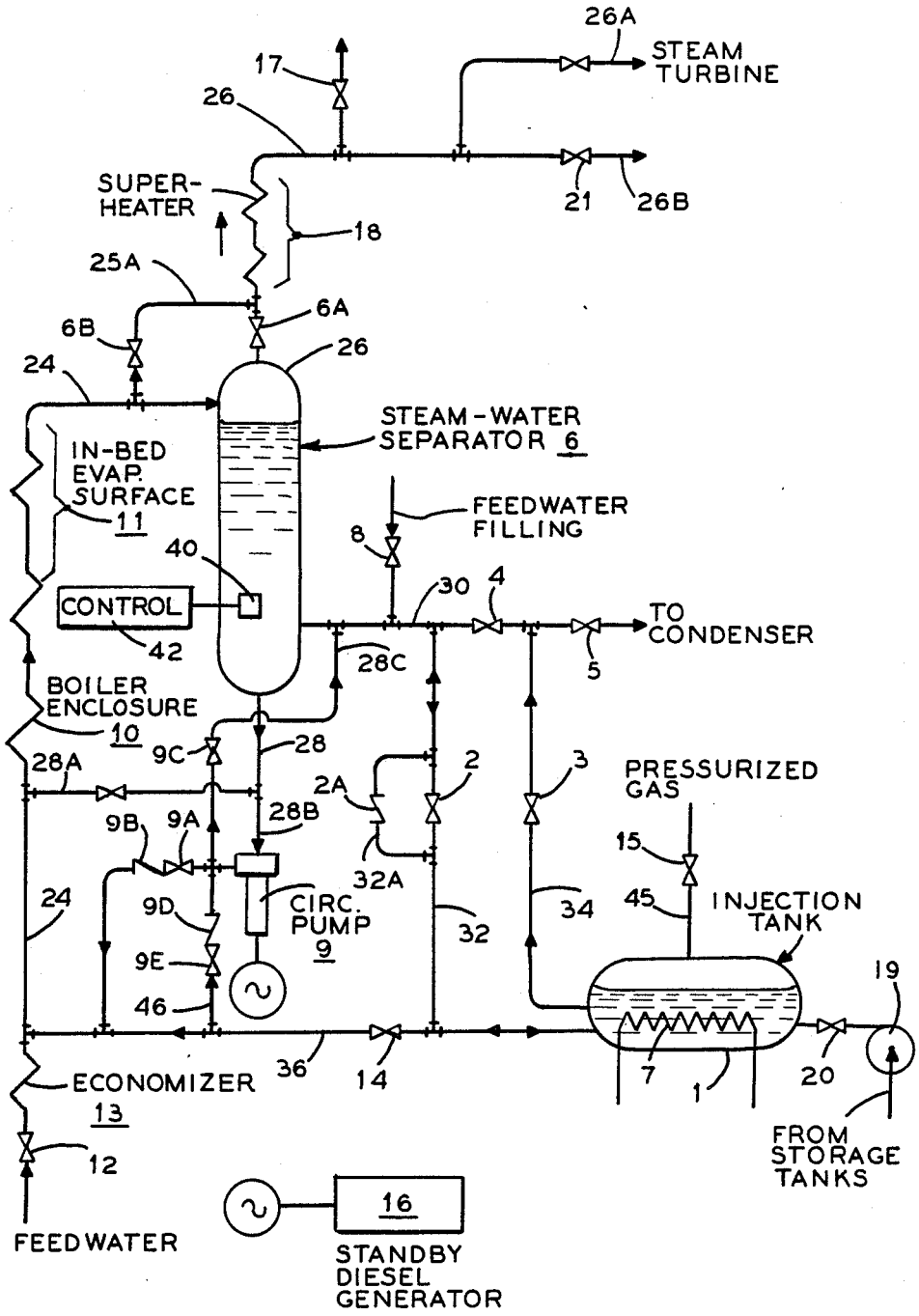
26A
STEAM TURBINE
17
26
SUPER-HEATER
18
21
26B
25A
6A
6B
26
24
STEAM-WATER SEPARATOR 6
IN-BED EVAP. SURFACE 11
FEEDWATER FILLING
8
40
30
4
CONTROL
42
TO CONDENSER
5
28C
BOILER ENCLOSURE 10
9C
28
28A
2
3
PRESSURIZED GAS
2A
28B
9B
9A
15
32A
24
9D
CIRC. PUMP 9
32
34
45
INJECTION TANK
9E
19
46
36
14
7
1
20
ECONOMIZER 13
12
FROM STORAGE TANKS
16
FEEDWATER
STANDBY DIESEL GENERATOR

STANDBY COOLING SYSTEM FOR A FLUIDIZED BED BOILER

FIELD AND BACKGROUND OF THE INVENTION

The present invention relates in general to fluidized bed boilers, and in particular, to a new and useful apparatus and method for supplying cooling liquid to the interior of the heat exchanger tubes for a fluidized bed boiler under emergency conditions to avoid rapid depressurization and thermal shock.

Once-through circulation of fluidized bed boilers requires an inventory system to maintain coolant in the event of a loss of normal coolant flow. A standby pump and storage tank for supplying coolant to the economizer of a boiler has been proposed in the past. However, rapid depressurization and thermal shocking when using low temperature coolants present a problem in that damage is likely to result to the heat exchanger tubes and attached components.

A Babcock and Wilcox Technical Paper entitled "The Fast Fluidized Bed-A True Multi-Fuel Boiler" by L. Stromberg et al presented to The Eighth International Conference of Fluidized-Bed Combustion, Houston, Tex., Mar. 18–21, 1985, discloses the structure and operation of a fast fluidized bed boiler utilizing enclosure wall, bed, superheater and economizer heat exchangers.

U.S. Pat. No. 4,563,267 to J. J. Graham et al discloses the problems of thermal shock for the steam generator coils of a fluidized bed reactor when the reactor is subjected to load changes.

A Babcock and Wilcox Technical Paper entitled "The Babcock & Wilcox Atmospheric Fluidized Bed Combustion Development Program" by J. W. Smith, presented to The Southeastern Electric Exchange, 1982 Annual Conference, Kissimmee, Fla., Apr. 21–23, 1982, discloses the structure and operation of atmospheric fluidized bed combustors. According to this technical paper, the fluidized bed in such combustors is at a temperature range of 1,500° F. to 1,600° F.

Fluidized bed combustors having tubular heat exchangers at various locations throughout the combustion gas flow path, as well as on the enclosure walls of the combustor are disclosed in U.S. Pat. No. 4,542,716 to J. Dreuilhe et al and U.S. Pat. No. 4,614,167 to J. Bergkvist.

SUMMARY OF THE INVENTION

The present invention is drawn to a system for protecting heat exchanger tubes of a fluidized bed boiler against thermal mismatch during transient operations, such as start up and shutdown. The fluidized bed boiler has at least one tubular heat exchanger which is supplied at one end with a coolant such as feedwater to be heated under pressure. The opposite end of the tubular heat exchanger is connected to a separator, preferably of vertical orientation, for separating the steam-water mixture discharging from the tubular heat exchanger. The system of the present invention comprises an injection tank for storing a supply of water. The injection tank is connected to the tubular heat exchanger through piping fitted with valves which can open and close communication between the injection tank and the tubular heat exchanger. The injection tank can be filled, warmed and pressurized as the fluidized bed boiler is started up using feedwater from the steam-water separator. At higher loads, a heater is provided in or around the injection tank for maintaining the temperature of the feedwater in the tank at about the temperature of the feedwater in the tubular heat exchanger. A source of pressurized gas maintains the necessary pressure to cause the water in the injection tank to flow through the tubular heat exchanger under emergency conditions.

When emergency conditions occur that prevent protection of the heat exchanger tubes through the normal feedwater supply, the emergency bed cooling system of the present invention will activate after a selected time delay to establish a flow of pressurized and preheated feedwater from the injection tank to the heat exchanger tubes. Thermal shock is avoided by maintaining the temperature of feedwater in the injection tank at about the temperature of the feedwater in the tubular heat exchanger.

Advantages of the invention include the fact that major components of the system are used during start up operations to improve operating characteristics. Thermal shock and rapid depressurization are much less severe on boiler components. Immediate injection ability for high flow demand, as well as lower flow rates that are required later during the operation of the boiler, are both provided by the present invention. The injection tank of the invention can be initially warmed up and matched with boiler feedwater temperature and pressure with less wasted energy. At high loads, the maintenance of thermal conditions for the emergency feedwater has much smaller energy requirements and does not need additional costly equipment.

The various features of novelty which characterize the invention are pointed out with particularity in the claims annexed to and forming a part of this disclosure. For a better understanding of the invention and its operating advantages, reference is made to the accompanying drawings and descriptive matter in which a preferred embodiment of the invention is illustrated.

IN THE DRAWING

The only FIGURE in the drawing is a schematic block diagram of the system for protecting components of a fluidized bed boiler in accordance with the present invention.

DESCRIPTION OF THE PREFERRED EMBODIMENT

Referring to the FIGURE in particular, the invention embodied therein comprises a system for protecting the fluidized bed boiler against thermal mismatch during transient operations, such as start up, shutdown and emergency conditions. The boiler has at least one tubular heat exchanger which is shown as a boiler enclosure surface 10 and an evaporation surface 11. A control valve 12 regulates the quantity of feedwater being supplied to the economizer 13. The heated feedwater discharging from the economizer 13 is conveyed through feedwater line 24 for further heating as it passes through the boiler enclosure surface 10 and the evaporation surface 11. The steam-water mixture discharging from the evaporation surface 11 is conveyed through steam-water line 25 to a steam-water separator 6. The steam is separated out of the mixture and is conveyed to one or more superheaters 18. The superheated steam is then conveyed through steam line 26 to branch lines 26A and 26B, the former conveys the steam to a turbine (not shown) and the latter by-passes the steam turbine and includes a control valve 21 which regulates the steam flow during turbine start up or shutdown. Steam line 26 connects to a vent line 27 which includes a pressure control valve 17 for regulating the depressurization and evaporative cooling of the superheaters 18. A valve 6A is located in steam line 26 at the discharge side of the steam-water separator 6. The valve 6A can be throttled during start up and shutdown of the fluidized bed boiler to increase the steam pressure in the separator 6. In the event that valve 17 becomes inoperative, valve 6A can be used to regulate the depressurization and evaporative cooling of the superheaters 18. A bypass line 25A connects steam-water line 25 with steam line 26 and includes a valve 6B which can be regulated to bypass steam around the separator 6 during high load operation thereby reducing pressure loss.

A condensate line 30 connects the lower end of separator 6 with a condenser (not shown) and provides the means for discharging feedwater from the separator 6 to the condenser. A feedwater filling line 29 is connected to condensate line 30 and includes a control valve 8 which operates to insure that the separator 6 will be supplied with the minimum feedwater required to maintain a net positive suction head for the circulation pump 9. The feedwater level in separator 6 is monitored by a controller 42 through a transducer 40. The controller 42 may be connected to control valve 8 to supply feedwater to the separator 6 when required.

Condensate line 30 includes valves 4 and 5 and is connected with an injection feedwater supply line 36 and a feedwater injection tank 1 through crossover line 32 and tank overflow line 34. The lines 32 and 34 include valves 2 and 3, respectively. A by-pass line 32A is provided around valve 2 and includes a non-return valve 2A which admits feedwater flow to the injection tank 1 from the separator 6 at all loads thereby maintaining the injection tank pressure at or near the vertical separator pressure. The valves 2, 3, 4 and 5 provide the means for selectively routing the flow of feedwater and condensate to and from the separator 6 and the injection tank 1, and the flow of condensate from the separator 6 to the condenser (not shown).

The injection tank 1 is activated by introducing a pressurized gas such as nitrogen through gas line 45. The pressure in the injection tank 1 is regulated by gas control valve 15 to cause the feedwater to flow from injection tank 1 through the boiler enclosure surface 10 and the evaporation surface 11 when control valve 14 in the injection feedwater supply line 36 is opened due to emergency conditions. A heater 7 is located within the injection tank 1 so that, at higher boiler loads, the temperature of the feedwater within the injection tank 1 is maintained at or about the same temperature as the temperature of the feedwater in the boiler enclosure surface 10 and the evaporation surface 11. A feedwater fill pump 19 delivers make-up water from one or more storage tanks (not shown) to the injection tank 1. A valve 20 is situated on the discharge side of pump 19 to admit make-up water to the injection tank 1.

The bottom of separator 6 is connected to circulation line 28 which branches into a natural circulation line 28A and boiler circulation pump inlet line 28B, the latter discharges to a boiler circulation pump 9 which is powered by the plant electrical system or by a standby diesel generator 16. Pump 9 is connected by way of discharge line 44, injection feedwater supply line 36 and feedwater line 24 to the boiler enclosure surface 10 and the evaporation surface 11 to circulate vertical separator water therethrough during cool-down of the bed. Line 28A includes a natural circulation valve 22 which, when opened, allows thermally induced (natural) circulation between the separator 6 and the boiler enclosure surface 10 and the evaporation surface 11 after shutdown of the pump 9. Line 28C includes valve 9C and interconnects condensate line 30 and boiler circulation discharge pump line 44 to accommodate the minimum recirculation flow required to protect pump 9. Discharge line 44 includes a control valve 9A and non-return valve 9B to regulate the output from pump 9. Line 46 interconnects the injection feedwater supply line 36 with line 44 at the discharge end of pump 9 to circulate feedwater for warming the pump 9 when the latter is out of service. Line 46 includes a control valve 9D and a non-return valve 9E.

The boiler enclosure surface 10 comprises heat exchanger tubes disposed in side-by-side fashion to form the enclosure which contains the fluidized bed. The evaporation surface 11 comprises bundles of heat exchanger tubes immersed in the fluidized bed. The boiler enclosure surface 10 and the evaporation surface 11 are of conventional design, well known in the field of fluidized bed boilers.

In accordance with the present invention, the injection tank is filled, warmed and pressurized as the fluidized bed boiler is started up. The valves 2A, 3 and 5 are opened to allow feedwater to flow from the separator 6 to the injection tank 1. Valve 4 opens at cold start up to allow flow to the condenser via valve 5 without flooding the vertical separator 6. During operation of the fluidized bed, the valves 2 and 3 are normally closed and, at higher loads, the heater 7 is activated to maintain the feedwater temperature in the injection tank 1 at substantially the same temperature as that of the feedwater flowing through the boiler enclosure surface 10 and the evaporation surface 11. As feedwater flow approaches a minimum requirement at low loads or under transient operating conditions, the separator 6 begins to run dry. Under such conditions, the control valve 8 will open to supply feedwater to the separator 6 thereby maintaining the required net positive suction head pressure for the circulation pump 9. The control valve 8 may also be opened at higher loads to maintain the feedwater in separator 6 at the level required to allow starting of the boiler circulation pump 9, when necessary.

The emergency bed cooling system of the present invention will activate after a selected time delay upon the occurrence of conditions which prevent protection of the boiler enclosure surface 10 and the evaporation surface 11 by the normal means of feedwater flow from the economizer 13 as regulated by control valve 12. When the emergency bed cooling system is activated, firing of the fluidized bed will be stopped, the injection feedwater control valve 14 will open, and the gas control valve 15 will regulate the gas pressure in the injection tank 1 to maintain up to 100% maximum continuous rated feedwater flow for about one minute or until feedwater cooling demand is reduced. If the circulation pump 9 is not in service and the separator 6 does not contain the required level of feedwater, valve 2 is opened to establish the feedwater level in separator 6 which will allow the starting of pump 9. As soon as pump 9 is able to deliver the selected feedwater flow to the boiler enclosure 10 and the evaporation surface 11, the flow of feedwater from the injection tank 1 through control valve 14 is discontinued. When the boiler enclosure 10 and the evaporation surface 11 have been cooled down to safe temperature levels, the pump 9 may be shutdown and the natural circulation valve 22 opened.

In the event of a total plant shutdown condition, the normal flowpaths are stopped causing the entire fluidized bed to be isolated. During this condition, the pressure control valve 17 will open to regulate the depressurization and evaporative cooling of the superheaters 18. The feedwater lost during the evaporative cooling of the superheaters 18 will be replaced through the emergency bed cooling system by activating the condensate fill pump 19 to deliver make-up feedwater to the injection tank 1 from one or more storage tanks (not shown). The flow of make-up feedwater to injection tank 1 is provided by valve 20.

While in accordance with the provisions of the statutes, there is illustrated and described herein specific embodiments of the invention, those skilled in the art will understand that changes may be made in the form of the invention covered by the claims, and certain features of the invention may sometimes be used to advantage without a corresponding use of the other features.

The embodiments of the invention in which an exclusive property or privilege is claimed are defined as follows:

1. A system for protecting components of a fluidized bed boiler against thermal mismatch during transient operations, the components including at least one heat exchanger communicating at one end with a feed coolant line supplying feed coolant to be heated and vaporized under pressure, and communicating at an opposite end with a separator for separating liquid coolant from vaporized coolant, the system comprising a coolant injection tank communicating with the feed coolant line for supplying coolant to the heat exchanger, valve means for opening and closing communication between the injection tank and the feed coolant line, means for heating the coolant in the injection tank to about the temperature of the feed coolant in the heat exchanger, the valve means being operable upon the occurrence of a thermal mismatch condition in the heat exchanger, and means for pressurizing the coolant in the injection tank to cause the coolant to flow through the heat exchanger during said thermal mismatch condition.

2. A system according to claim 1 wherein the heating means includes an injection coolant filling line connecting the separator with the injection tank for supplying warmed liquid coolant from the separator to said injection tank.

3. A system according to claim 2 wherein the heating means includes a heater associated with the injection tank for heating the coolant in said injection tank.

4. A system according to claim 1 wherein the pressurization means includes a source of pressurized gas, a gas line connecting the source of pressurized gas with the injection tank, and a control valve disposed in the gas line for regulating the supply of pressurized gas from the source to said injection tank.

5. A system according to claim 1 including an injection coolant supply line connecting the injection tank with the feed coolant line, the valve means comprising an injection feedwater control valve in the injection coolant supply line for regulating the flow of coolant between the injection tank and said feed coolant line.

6. A system according to claim 5 including a condensate line connecting the separator with the injection coolant supply line for delivering liquid coolant from the separator to the injection tank.

7. A system according to claim 6 including a coolant filling line connected to the condensate line and a control valve disposed in the filling line for regulating the supply of coolant to the separator upon the occurrence of a low liquid coolant condition in the separator.

8. A system according to claim 1 including a circulating pump communicating with the separator and the heat exchanger for circulating liquid coolant from the separator to the heat exchanger.

9. A system according to claim 1 including a natural circulation line connected between the separator and the feed coolant line, a valve disposed in the natural circulation line, the valve being opened to permit natural circulation between the separator and said heat exchanger when such circulation is possible and desired.

10. A system according to claim 9 including a standby generator for generating electricity, the standby generator being connected to the boiler circulation pump for supplying electrical power to said pump under emergency conditions.

11. A system according to claim 1 wherein the heat exchanger comprises a boiler enclosure surface and an evaporation surface connected in series with the boiler enclosure surface, the injection coolant supply line being connected to the feed coolant line ahead of said boiler enclosure surface.

12. A system according to claim 1 including a fill pump connected to the injection tank for supplying coolant to said injection tank.

13. A system according to claim 1 including means for supplying coolant from the separator to said injection tank.

14. A method of protecting components of a fluidized bed boiler against thermal mismatch during transient operations, the components including at least one heat exchanger communicating at one end with a feed coolant line supplying feed coolant to be heated and vaporized under pressure, and communicating at an opposite end with a separator for separating liquid coolant from vaporized coolant, the method comprising:

connecting an injection tank with the separator for filling the injection tank with warmed liquid coolant during start up of the fluidized bed boiler;

connecting the injection tank with the feed coolant line ahead of the heat exchanger;

maintaining the temperature of the coolant in the injection tank at about the temperature of the feed coolant in the heat exchanger; and pressurizing the coolant in the injection tank whereupon during the occurrence of a thermal mismatch condition the coolant in the injection tank is caused to flow from the injection tank to said heat exchanger.

* * * * *